US007435952B2

(12) United States Patent
Finlay et al.

(10) Patent No.: US 7,435,952 B2
(45) Date of Patent: Oct. 14, 2008

(54) INTEGRATED ANALYTICAL DEVICE

(75) Inventors: Alan Finlay, Surrey (GB); Eric Yeatman, London (GB); Steven Wright, West Sussex (GB)

(73) Assignee: Microsaic Systems Limited, Surrey (GB)

( * ) Notice: Subject to any disclaimer, the term of this patent is extended or adjusted under 35 U.S.C. 154(b) by 273 days.

(21) Appl. No.: 11/348,706

(22) Filed: Feb. 7, 2006

(65) Prior Publication Data

US 2006/0192108 A1 Aug. 31, 2006

(30) Foreign Application Priority Data

Feb. 7, 2005 (GB) ..... 0502357.7

(51) Int. Cl.
*H01J 49/42* (2006.01)

(52) U.S. Cl. ..... 250/292

(58) Field of Classification Search ..... 250/292, 250/288

See application file for complete search history.

(56) References Cited

U.S. PATENT DOCUMENTS

| | | | | |
|---|---|---|---|---|
| 5,313,061 | A | 5/1994 | Drew et al. | |
| 5,386,115 | A | 1/1995 | Freidhoff et al. | |
| 5,536,939 | A | 7/1996 | Freidhoff et al. | |
| 6,025,591 | A | 2/2000 | Taylor et al. | |
| 6,525,314 | B1 | 2/2003 | Jarrell et al. | |
| 2007/0057179 | A1 * | 3/2007 | Bousse et al. | 250/288 |

* cited by examiner

*Primary Examiner*—Kiet T Nguyen
(74) *Attorney, Agent, or Firm*—McDermott Will & Emery LLP

(57) ABSTRACT

An integrated analytical device is described. The device includes a plurality of components which are initially mounted or provided on support submounts. The submounts are then packaged onto a microbench, with the alignment of the submounts relative to the microbench being determined by alignment features provided on the microbench.

34 Claims, 9 Drawing Sheets

INTEGRATED ANALYTICAL DEVICE

CROSS-REFERENCE TO RELATED APPLICATION

This application claims priority from British Appln. No. 0502357.7, filed Feb. 7, 2005, incorporated herein by reference.

FIELD OF THE INVENTION

The present invention relates to analytical devices or instruments and in particular to analytical instrumentation utilising electrospray ionisation spray devices and mass spectrometers. The invention particularly relates to an integrated mass spectrometer and ionisation spray device where the individual components are packaged together and provided as a single unit.

BACKGROUND OF THE INVENTION

Mass spectrometry (MS) is a powerful analytical technique that is used for the qualitative and quantitative identification of organic molecules, peptides, proteins and nucleic acids. MS offers speed, accuracy and high sensitivity. The development of ionisation techniques and mass analysers over the last decade has enables MS to solve a wide variety of problems. The introduction of Electrospray ionisation (ESI) greatly expanded the role of MS in pharmaceutical analysis. One of the characteristic features of ESI is the generation of multiply charged ions for large molecular weight compounds (e.g. proteins, peptides). These differently charged molecules enable accurate determination of the molecular weight of these compounds and their analysis in complex biological media.

In ESI, the analyte solution is typically introduced into a capillary which is electrically conductive or has a conductive coating. An electric potential is applied between the capillary and a counter-electrode. The analyte solution extends from the tip of the capillary in a shape known as the Taylor cone. The applied potential accelerates charged droplets from this cone towards the counter-electrode. The droplets reduce by fragmentation or evaporation to individual ions, and these are accelerated, typically through an aperture in the counter-electrode, into the mass analyser. Important features of ESI are the simplicity of its source design, and its capability to operate with solutions at atmospheric pressure. This means ESI may be coupled to high performance liquid chromatography (HPLC) for analysis of complex mixtures. The HPLC/MS combination uses the separation of HPLC with the detection of MS. ESI is also extremely sensitive. Furthermore, ESI is a soft ionisation technique that yields a simple, unfragmented and easily interpreted mass spectrum in which molecules typically correspond to the base peak. ESI is the method of choice of the characterisation of drug-bearing compounds and can be applied to over 90% of organic compounds in pharmaceutical research.

In the field of compound analysis it is known to use multiplexed, or MUX, systems with for example 4 to 8 channels feeding into a single mass analyser. However 'cross-talk' between the tips is a problem which can result in cross-contamination of sample sprays, thereby limiting the expansion of these systems to high numbers of channels. A further problem arises in the possibility that ions from previous stream are often still present. Furthermore when providing a plurality of channels, a separate bank of binary pump, splitters, LC and UV detector is required for each channel. If the cost and size of the ESI-MS system could be reduced, users could opt for arrays of ESI-MS systems running in parallel with maximum throughput and zero cross-talk.

HPLC flow splitters are often used to couple mass spectrometers to liquid chromatographs to reduce the amount and concentration of sample delivered to the mass spectrometers. This is particularly useful in automated systems to avoid unwanted MS inlet overload. Splitting is also required for applications in which a second detector or fraction collection device is used parallel to the MS (e.g. UV detector). HPLC/MS flow splitting is typical in the automated analysis of combinatorial libraries, drug metabolites and the characterisation of impurities.

In traditional HPLC/MS systems, the use of a postcolumn splitter decouples the chromatographic and Electrospray flow rates. The column operates at a high flow rate to provide optimal resolution, while the ESI source operates at a lower flow that is compatible with Electrospray or pneumatically assisted Electrospray. However, the integration of the Electrospray electrode with the column narrows the flow range that can be used. Thus, it becomes desirable to use electrodes with as broad a flow as possible.

For HPLC/MS with a low flow rate (100-200 μL/min), the sample solution can be sprayed directly into the ESI source. However, most samples in the pharmaceutical industry require HPLC separations at high flow rates (0.5-2 mL/min). A postcolumn split is often used to reduce actual flow rates to the ESI source to 40-200 μL/min. HPLC columns with smaller diameters are used for low concentrations of organic compounds and biomolecules and have flow rates of 1-40 μL/min. Alternatively, a nanoflow device (e.g. capillary LC) can deliver a sample solution directly to a nanospray source for analysis.

High flow rates are important to ensure compatibility with most HPLC systems. To initiate a spray requires very well defined electric fields; therefore factors such as applied voltage, needle diameter and position are critical. However, because electrospray is relatively difficult to achieve and maintain for traditional high flow rate ESI sources, pneumatic, ultrasonic or thermal nebulisation is also required to break up droplets in a process called desolvation. Such desolvation techniques add greatly to source complexity and cost.

Operating electrospray at high flow rates is forcing the process into an unnatural state, where stabilisation of what is called the Taylor Cone and formation of aerosol droplets are practically impossible with electric fields alone. To generate stable ion currents one must provide additional energy input, in the form of pneumatic nebulisation and heat, to force droplet formation, leaving the task of droplet charging to the electric field. Proper implementation of this additional energy is of overriding concern in the design of high flow rate systems, far overshadowing in importance other details of the Electrospray process such as Taylor Cone formation and stabilisation. For nanoflow techniques the opposite is true; factors affecting the formation and stabilisation of the Taylor Cone are of paramount concern. Other forms of external energy input to generate charged droplets are not required because the electric field is sufficient to charge the liquid and simultaneously generate an aerosol.

Nanospray sources operate in the low microliter per minute flow ranges. Nanospray involves using a low flow rate and a small needle diameter. The spray is introduced directly into the vacuum interface without pneumatic, ultrasonic or thermal nebulisation, reducing system cost and complexity. Nanospray permits the use of low flow techniques like microcapillary liquid chromatography (μLC) and capillary electrophoresis. Very small samples can be separated quickly and efficiently and analysed over a long period of time. Another benefit arises from the reduction in onset potential that comes with decreasing the needle diameter. This facilitates the use of aqueous solutions and reduces the likelihood of corona discharge.

The essence of the nanoflow method is to reduce the flow rate of the sprayed sample liquid by orders of magnitude below the microliter per minute regime. As stable flows are achieved at lower and lower flow rates, the efficiency of the ionisation process improves approximately in proportion to the flow rate reduction. Even though the sample molecules enter the sprayer at a much lower rate than with the high flow systems, the signal per unit time detected by the MS remains constant and can often be seen to improve by factors of 2-3.

For a given mass of sample injected, the analyte concentration, [A] is inversely proportional to the square of the column internal diameter, d. As the column diameter is reduced, the optimum flow rate Q also lowers by the same function.

Similarly, the ionisation efficiency E increases with lower flows.

$$[A] \propto 1/d^2;\ Q \propto 1/d^2;\ E \propto 1/d^2 \qquad \text{Equation. 1}$$

The outer diameter of the tip at the end of the capillary electrode establishes the minimum voltage required to produce sufficient electric field strength to initiate the Electrospray process. As such, sharper tips can generally be operated closer to the entrance aperture of the mass spectrometer. The taper of the channel leading up to the exit aperture and the restriction to flow it imposes also have an effect; long narrow channel results in flows somewhat lower than expected for a particular diameter.

At a lower cone voltage, the multiply charged ions are present at high relative abundances. For example, doubly charged ions of small peptides are intrinsically less stable than their singly charged analogs, and they can easily fragment to form singly charges ions. Low cone voltages can therefore be used to generate multiply charged ions of large molecules, permitting their detection by instruments with limited mass to charge range.

Because the spray is generated by strictly electrostatic means, the needle diameter, position and applied potential are critical. The potential $V_{on}$ (kV) required for the onset of electrospray is related to the radius r (μm) of the electrospray needle, the surface tension of the solvent, γ (N/m), and the distance d (mm), between the needle tip and the counter electrode, which is sometimes also the vacuum orifice:

$$V_{on} \approx 0.2\sqrt{(r\gamma)}\ln(4000d/r) \qquad \text{Equation. 2}$$

With methanol as the solvent (γ=0.0226 N/m), a spray needle radius of 50 μm, and a needle-counter electrode distance of 5 mm, the onset potential is 1.27 kV. Changing the solvent to water (γ=0.073 N/m) increases the onset potential to 2.29 kV. A possible problem with high applied potentials is that they can cause electric discharge from the capillary tip.

One solution to the problem of electric discharge is to reduce the needle diameter. In the pure water example changing the needle diameter from 50 μm to 10 μm decreases the onset potential from 2.29 kV to 1.3 kV. A reduction in the potential required to initiate a spray is one of several benefits of nanospray techniques.

Another solution is to reduce the needle-counter electrode distance. For example, for a spray needle radius of 50 μm, reducing the needle-counter electrode distance from 5 mm to 100 μm decreases the onset potential from 1.27 kV to 442 V.

Both these solutions require accurate alignment of the needle. Today, in order to achieve the necessary alignment, nanospray capillaries are mounted on an assembly of carefully machined stainless steel and ceramic parts, and located using expensive micro-positioners typically costing tens of thousands of dollars. A video camera is often included to help the user find the optimum position for Taylor cone formation, adding yet more cost.

There is therefore a need to provide a device and method that can provide for integration and alignment of the necessary components for such analytical instruments.

SUMMARY OF THE INVENTION

The present invention addresses these and other problems by providing one or more features that precisely locate and align nanospray capillaries, counter electrodes and vacuum interface in a manner that can be reproducibly and cheaply microfabricated from a substrate, thereby eliminating expensive assemblies. Batches of mounting blocks can be produced on wafer, significantly reducing manufacturing and assembly cost.

The invention also addresses problems arising from contamination due to neutral solvents which is a problem in many traditional ESI mass spectrometers. Continued cleaning and reconditioning of ion sources and optics and mass analysers is traditionally required which significantly increases after sales costs. The assembly described in this patent could be removed or even potentially disposable, increasing system ease of use, availability and reducing the cost of ownership.

Accordingly, a first embodiment of the invention provides for precision alignment of the principal electrospray source elements (i.e. electrospray capillary needle, counter electrode, vacuum inlet, ion optics, mass analyser and ion current detector) relative to features micromachined on a parent substrate as a means of reducing onset potential and cone voltage, increasing transmission, cost and the number of multiply charged ions and therefore boosting analyser mass range.

The present invention provides for an assembly as claimed in claim 1. Advantageous embodiments are provided in the dependent claims thereto. The invention also provides, in a further embodiment, a mass spectrometer system as claimed in claim 30. The invention also provides a method of providing a self aligned mass-analysing assembly as detailed in claim 34. The invention furthermore provides for an assembly substantially as hereinafter described with reference to any one of FIGS. 1 to 10.

BRIEF DESCRIPTION OF THE DRAWINGS

The present invention will now be described with reference to the accompanying drawings in which:

FIG. 4C is a plan view of the housing of FIG. 4A mounted on a microbench with associated submounts assembled, while

DETAILED DESCRIPTION

The present invention will now be described with reference to FIGS. 1 to 10.

Figure 1:
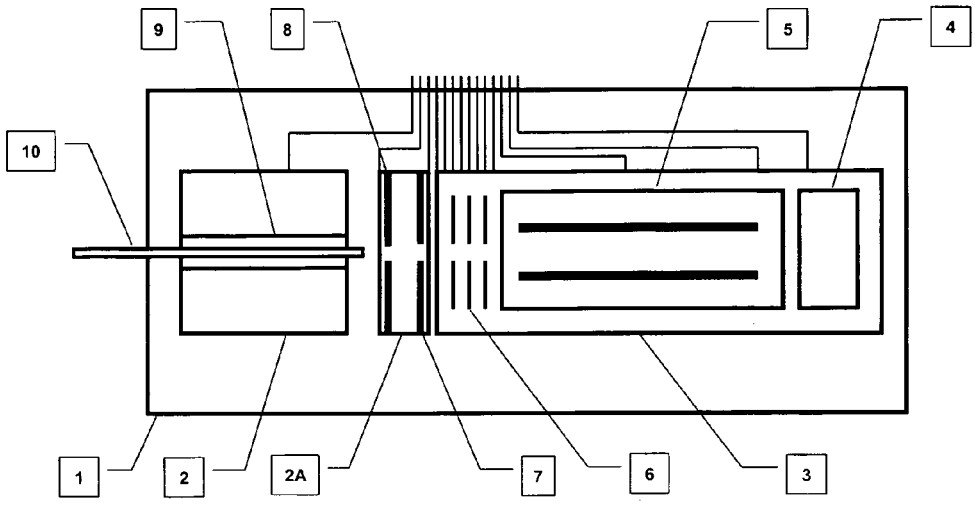
FIG. 1 is a schematic of an analytical instrument assembly according to an illustrated embodiment of the present invention.

As shown in FIG. 1, the invention provides an assembly in which a substrate or microbench (1) is used to mount a capillary submount (2), a counter-electrode submount (2A) and a mass spectrometer submount (3) such that all three are firmly co-located and precisely aligned. The capillary submount (2) is dimensioned to support a capillary needle. The counter electrode submount (2A) has provided thereon ring electrodes (7) & (8) and the mass spectrometer submount (3) has provided thereon ion optics (6), ion detector (4) and a mass analyser (5). With regard to the capillary submount and the mass spectrometer submounts, it will be appreciated that the components provided thereon could be formed separately and subsequently bonded to their respective submounts or alternatively integrally formed with the submount. The substrate material can be any suitable metal (e.g. stainless steel), insulator (e.g. PEEK), ceramic (e.g. alumina), glass (e.g. Pyrex), semiconductor (e.g. silicon or bonded silicon on insulator). The microbench is provided with one or more alignment features which are then utilised in the subsequent placing of the submounts on the microbench so as to ensure accurate positioning of each of the components relative to one another. In order to achieve accurate alignment it will be appreciated that a specific feature of each of the submounts needs to be aligned with its respective alignment feature on the microbench. The alignment can be achieved by matching the two together or seating a submount within an alignment feature formed in an upper surface of the microbench.

In assembly, each of the submounts are positioned relative to a pre-allocated alignment feature on the microbench and then secured in that position. As the alignment is achieved using tolerances based on the ability to accurately define the location of features on the microbench, and these features can be laid down or applied in the same processing step, it is possible using the techniques of the present invention to accurately position each of the submounts relative to one another. In the exemplary embodiments hereinafter described a plurality of alignment features will be described but it will be appreciated that in certain applications and embodiments that one alignment feature may be required which is then used to define a known position on the substrate. Having this known position on the substrate, it is then possible to apply each of the submounts relative to this one alignment feature. As such the term alignment feature when used herein intended to encompass one or more unique features. For example, a plurality of features (e.g. v-grooves) or some fiduciary feature may be found more suitable in certain instances. In the provision of a plurality of alignment features using photolithographic techniques the alignment features are defined with respect to one another during the photolithography. If the alignment features are formed using micromachining lasing techniques, the machined features will typically be machined relative to one selected fiduciary point.

The capillary submount (2) desirably includes microfabricated location features (9) for precision alignment of the capillary needle (10) relative to the counter electrodes (8) & (7). The capillary location feature (9) can be microfabricated in several ways including a deep-etched microchannel, or a v-groove wet-etched along crystal planes. The capillary needle may be attached using suitable clips, microsprings, solder or conductive epoxy for electrical connectivity.

The mass spectrometer submount (3) includes an ion detector (4), ion optics (6) and mass analyser (5). The ion detector can be an electron multiplier or faraday cup. The mass analyser can be a quadrupole; magnetic sector; quadrupole ion trap; linear ion trap; cyclotron; Fourier transfer; triple quadrupole or tandem mass filter. The ion optics typically form an Einzel lens. Examples of suitable mass spectrometer devices include that described in international application WO2003EP08354.

The submounts (2), (2A) & (3) may be integrated into several different combinations in alternative embodiments. The capillary submount (2) may be monolithically integrated with the counter-electrode submount (2A), or the mass spectrometer submount (3) may be monolithically integrated with the counter-electrode submount (2A), or all three may be integrated onto a single substrate. In this last embodiment, all of the components are monolithically formed or integrated onto a single chip, the alignment features for the needle being provided on that chip, and the chip is then subsequently mounted on the substrate microbench.

Figure 2:
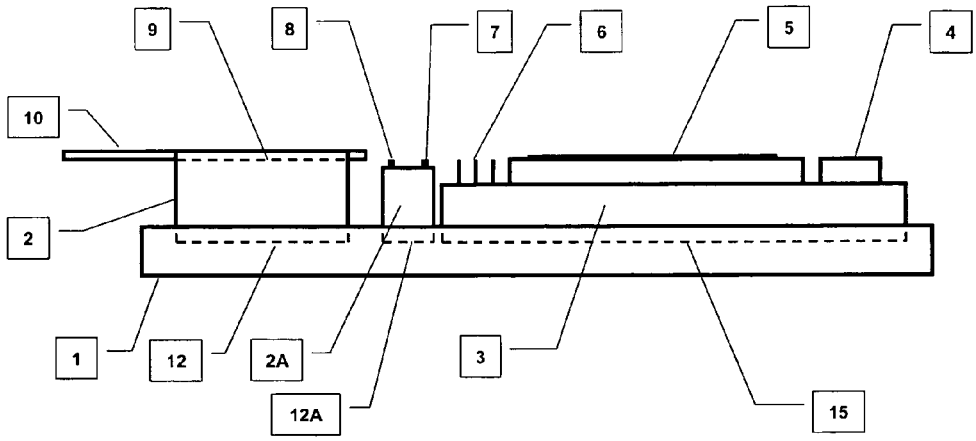
FIG. 2 is a side elevation of the assembly of FIG. 1.

FIG. 2 shows a side elevation view of the same assembly of FIG. 1 with each of the microfabricated features (12), (12A) and (5), locating each submount, being described in more detail below.

Figure 3:
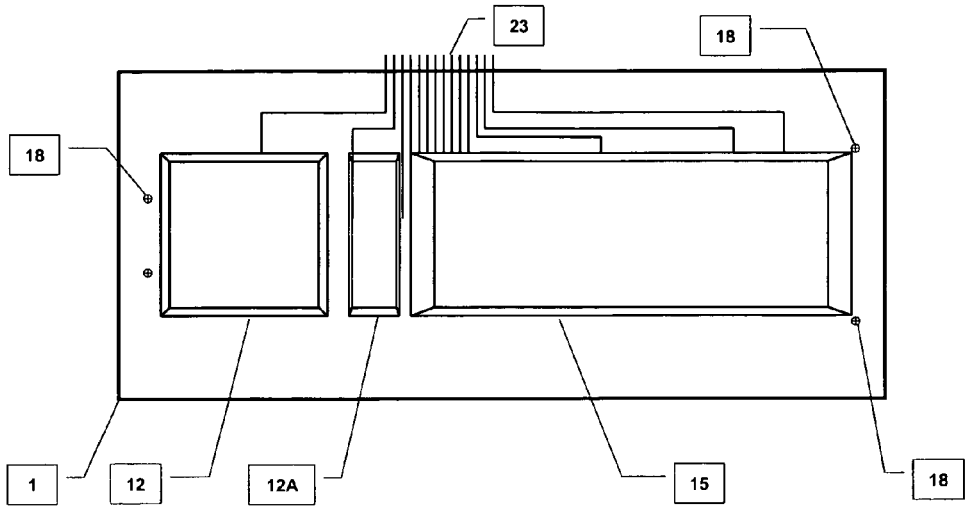
FIG. 3 is a schematic of alignment features provided on a microbench.
Figure 4A:
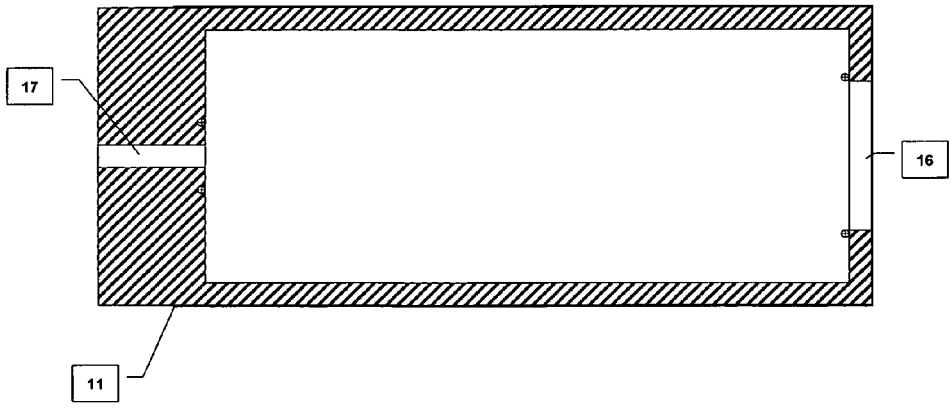
FIG. 4A is a cut-away plan view of a housing for use with the assembly of FIG. 1.
Figure 4B:
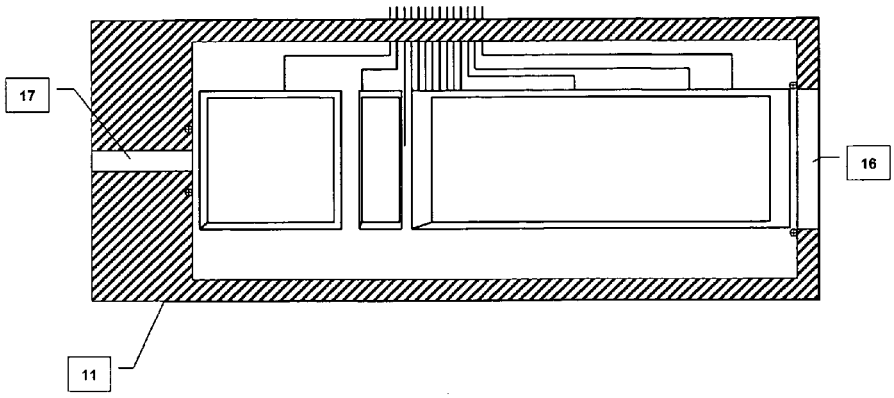
FIG. 4B shows the housing of FIG. 4A mounted on the microbench substrate.
Figure 4C:
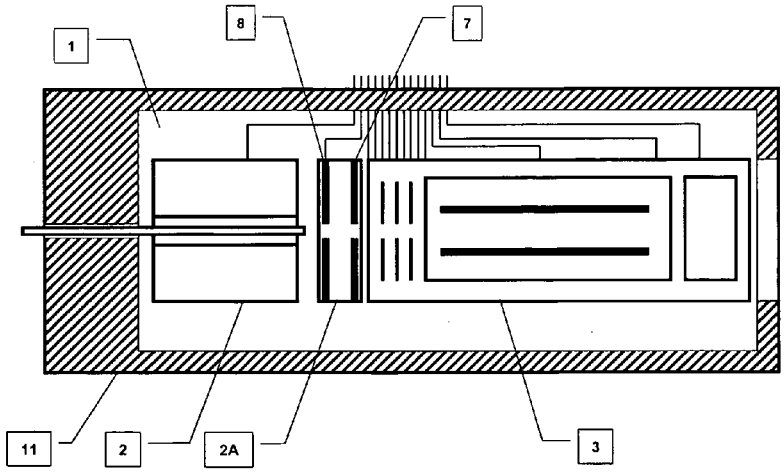
Figure 4D:
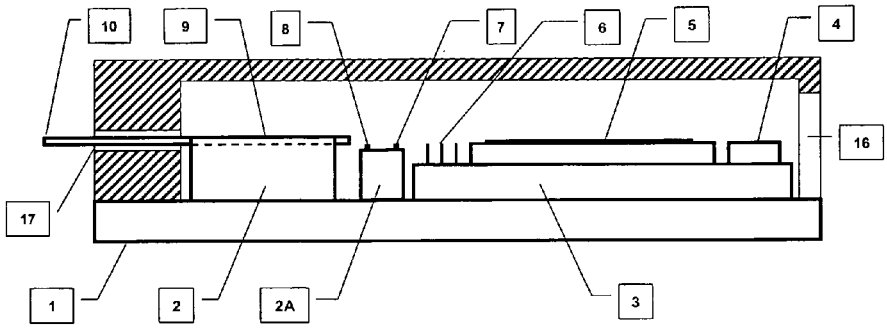
FIG. 4D is a cutaway view of a side elevation view of the same assembly.

FIG. 3 is a schematic of alignment features on the bare microbench. The definition of alignment features on the substrate (1) will typically be carried out by the fabrication of a patterned layer using photolithographic methods. This layer may be directly attached to the substrate material or alternatively may be superimposed on additional deposited layers. Alignment features defined in the patterned layer may be fabricated in the substrate or the additional layers through the use of etching techniques such as wet chemical etching or reactive ion etching. The patterned layer may also be used to fabricate alignment features in a subsequently deposited layer by using the lift-off technique as is well known in the art. As an alternative to photolithographic techniques, alignment features may be fabricated using a numerically controlled direct-write process such as laser micromachining, as is known in the art.

Alignment features (12), (12A), (15) & (18) are thus provided on the surface (the upper surface) of the substrate (1) for precision co-location of the capillary submount, mass spectrometer submount, counter electrode submount and package housing. These features together with corresponding features provided in the submounts may form references for visual or automated alignment of submounts to the substrate prior to the attachment of the submounts to the substrate by soldering, glueing, anodic bonding or other bonding technique. These features (12), (12A), (15) & (18) may also provide for the mechanical location of submounts, such that correct alignment is obtained by the placement of a submount against such a feature or features. As an example features (12), (12A) and (15) may have the form of precise recessed regions such as v-grooves wet-etched in a silicon substrate along crystal planes. Submounts (2), (2A) & (3) may in such case be provided with protrusions fitting precisely into or against the substrate features (12), (12A) and (15) so providing for the precise location of the submounts prior to bonding them to the substrates. In another embodiment additional parts are used to provide alignment between submounts and substrate. One such embodiment uses glass or other cylindrical rods, fitted in v-grooves or microchannels provided on the surfaces of both substrate (1) and submounts (2), (2A) & (3) to co-align all submounts. These and other techniques are exemplary of the type of techniques that may be used to provide and use alignment features, as will be appreciated by the person skilled in the art, and it is not intended to limit the invention to any one specific technique.

The position of alignment features (12), (12A), (15) & (18) is determined by the required position of the electrospray capillary needle necessary to create the optimum electrical field for Taylor cone formation (see Equation 2). In particular, the distance between the nozzle (9) and the counter-electrodes (7) & (8) should be such that the onset potential is easily achieved to ensure reproducible and stable Taylor cones. Furthermore, this distance should also optimise the formation and transmission of multiply charged ions in order to maximise mass analyser (5) sensitivity and mass range.

Conductive tracks may be provided on the substrate (1) by use of photolithographic, screenprinting or other techniques known in the art. These tracks may provide electrical connection between individual electrical attachment points for individual submounts and a common interface between the substrate and external systems. The attachment points may comprise bond pads for connection to corresponding bond pads on submounts or submount assemblies. The bonding may be done by wire bonding or by direct bonding methods using for example solder bumps or balls. The common interface may comprise an edge connector (23) or other multi-way electrical connector. The tracks so provided may permit transmission of electrical power; drive signals from external drive electronics to the mass analyser (5); high electrical potentials to the counter electrodes (7) & (8) and ion optics (6); and output signals from the detector (4) to external data acquisition electronics.

FIG. 4(*a*) is a cutaway, in plan view, of a housing (11) which may be used to enclose the microbench (1). This housing serves as a 'lid' or 'package' protecting, encapsulating and partitioning the microbench assembly. The housing material can be any suitable insulator (e.g. PEEK), ceramic (e.g. alumina), glass (e.g. Pyrex), semiconductor (e.g. silicon, bonded silicon on insulator) or metal (e.g. stainless steel).

The primary purpose of the enclosure is to create regions of different pressure. In this illustrated embodiment, the capillary needle submount and counter-electrode submount are mounted inside the same region of high to medium vacuum as the mass spectrometer submount. An inlet (17) is designed such that its cross section is greater than that of the capillary needle (10), which can be comfortably fitted or removed. The capillary needle (10) may be inserted into the vacuum through a suitable septum or membrane, which is mounted in the inlet (17). In this way the vacuum in the housing is completely sealed, and the capillary may be easily inserted and removed. A suitable septum is of the type used in gas chromatography inlets, or in solid phase micro-extraction (SPME) applications and these are widely available. A typical material for this septum is silicone rubber. The inlet's cross sectional area, length and conductance may also be designed to realise a steep pressure gradient from an atmospheric pressure at the inlet down to a vacuum pressure at the exit. Inlet (16) is designed so that there is very high conductance to the turbo pump, roughing pump or vacuum system, maximising effective pumping speed.

In FIG. 4(*b*), the housing (11) is mounted relative to alignment features (18) on the microbench substrate (1), and permanently attached. In one embodiment, the housing (11) material is selected so that it can be permanently sealed or chemically bonded to the substrate (1). Leak proof seals between the substrate (1) and the housing (11) can be achieved using a variety of techniques such as anodic bonding, a soldering process, or by melting glass frit between two surfaces. Leak-proof, hermetic seals are also possible around the edge connector (23) using anodic bonding, laser bonding, glass frit, solder reflow or glass blown interconnects or ceramic feedthroughs.

FIG. 4(*c*) is a plan view of the housing (11) attached to the assembled microbench (1) with submounts (2), (2A) and (3) in place. FIG. 4 (*d*) is a cutaway of a side elevation view of the same assembly. The location of critical components is precisely defined; the capillary nozzle (10), counter-electrodes (7) & (8), ion optics (6) and mass analyser (5) are in alignment at specified distances.

An alternative housing design, shown in varying degrees of assembly in FIGS. 5(*a*) to 5(*c*) provides for two separates areas within the housing by use of a partition (13) with the resultant areas being maintained at different pressures such that there is a steep pressure gradient between the capillary nozzle, counter-electrodes and mass spectrometer submount. In this design, the electrospray source is outside the vacuum and is at atmospheric, or close to atmospheric, pressure in order to promote evaporation of the solvent, droplet formation and reduction of ion energy through collision with atmospheric gas molecules. The two areas are linked by means of an aperture (14) provided in the partition wall (13).

Figure 5A:
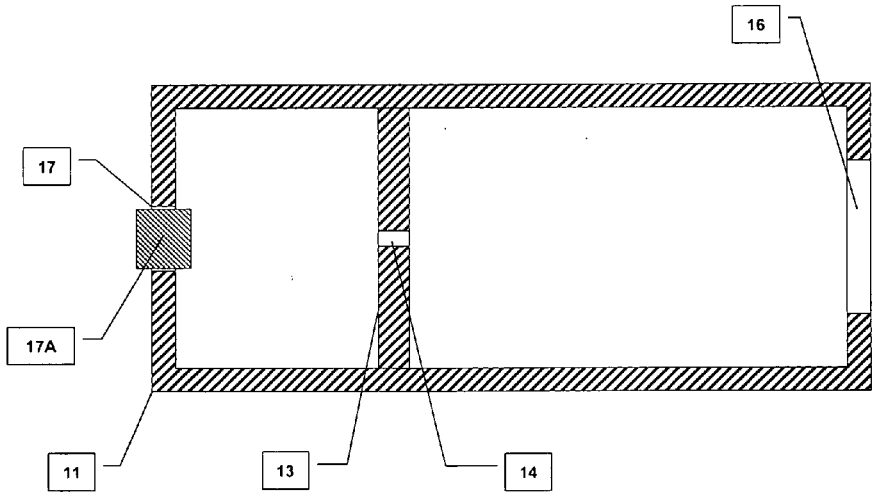
FIG. 5A shows in plan view an alternative housing to that of FIG. 4.
Figure 5B:
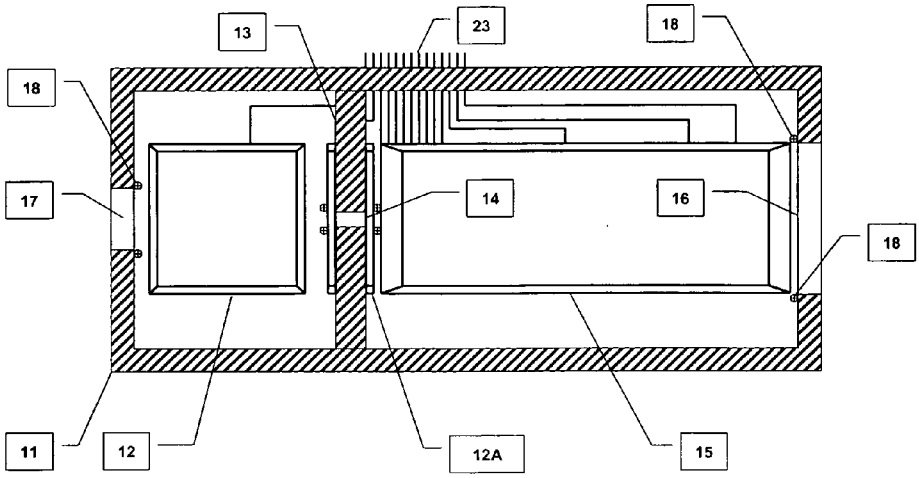
FIG. 5B is a schematic of the housing of FIG. 5A enclosing a microbench.
Figure 5C:
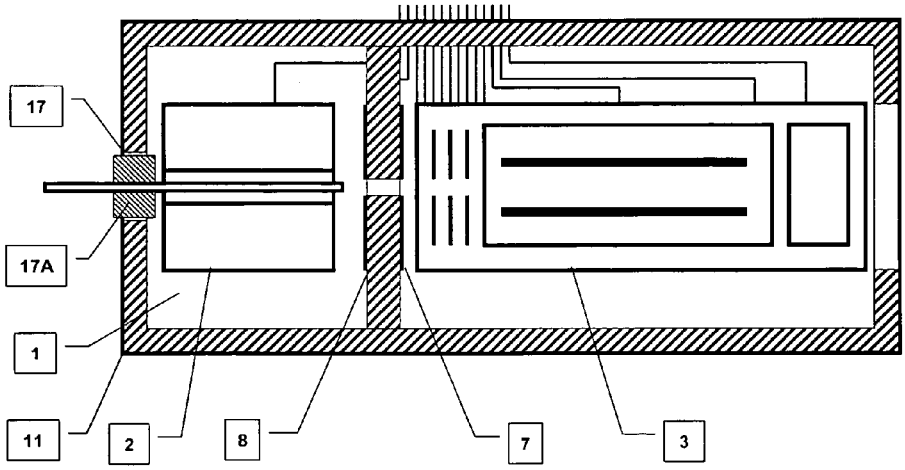
FIG. 5C is a schematic of the housing of FIG. 5A enclosing a microbench.
Figure 5D:
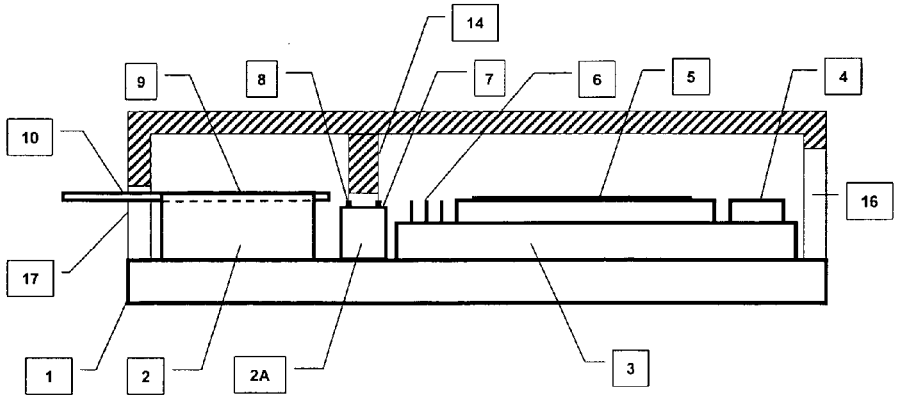
FIG. 5D is a side view of the schematic of FIG. 5C.
Figure 5E:
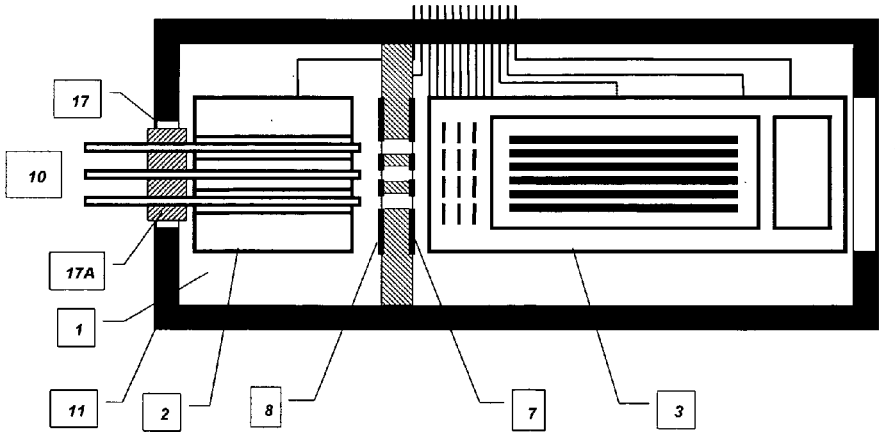
FIG. 5E is a plan view of a modification of the schematic of FIG. 5C so as to provide for an array of capillaries.

As shown, in the embodiment of FIG. 5*c*, the inlet (17) may also support a suitable permeable membrane or septum (17A) to permit a controlled transmission of gases to a first region of high pressure—that area defined between the first aperture (17) and the second aperture (14), so that the electrospray needle tip (10) is at close to atmospheric pressure. The membrane (17A) material may be silicone rubber. This first region of higher pressure may also be connected to a mechanical roughing pump (22) to give greater control over pressure at the needle tip. The second aperture (14) should have a narrow cross sectional area in order to create a pressure drop along its length. Ideally, a rough vacuum of 100 Torr to 1 Torr is created between the counter electrodes (7) & (8), and a medium vacuum, of between $10^{-4}$ Torr and $10^{-5}$ Torr, at the ion detector (4), ion optics (6) and mass analyser (5). The dimensions of this aperture (14) must ensure an acceptable response time at the mass analyser. The inlet (14) may also be a glass or stainless steel capillary. Provision may also be required for heating of the aperture (14) to improve response time and ion transmission. However, in every case the inlet is optimally configured so that the pressure at the electrospray nozzle is near atmosphere or rough vacuum, and the pressure at the mass analyser is at medium vacuum.

FIGS. 5(*b*) & (*c*) are schematics of the housing enclosing a microbench (1). In this embodiment, the inlet (14) is positioned such that a counter-electrodes submount (2A) mates with the partition (13), forming part of aperture (14), so that the counter electrodes (7) & (8) are either side of partition (13). FIG. 5(*d*) is a side elevation of the same schematic. It will be appreciated that the use of micromachined submounts (2), (2A) & (3), located on micromachined alignment features on substrate (1), also provide excellent axial alignment in height.

An alternative embodiment is that the counter-electrodes (7) & (8) are permanently attached to the housing wall (13) rather than mounted on submount (2A). In this way metal counter-electrodes with appropriate geometries such as circular apertures may be separately machined and fixed to the housing wall prior to assembly around the capillary and mass spectrometer submounts (2) and (3). Precision alignment of the counter-electrodes (7) and (8) relative to submounts (2) and (3) is achieved through the location of the housing with respect to micromachined features (12), (12A), (15) & (18).

In another embodiment it may be desirable to perform several analyses in parallel using an array of capillary sources with corresponding arrays of counter-electrodes and mass analysers. In this embodiment as illustrated in the example of FIG. 5(*e*) as an array of three, submounts are provided for each of a linear array of capillaries, an array of counter-electrodes, and an array of mass analysers. Alignment features (12) (12A) (15) on the substrate provide for the alignment of the corresponding submounts such that each capillary in the array is correctly aligned with its corresponding counter-electrode and mass analyser. In this embodiment, three apertures are also formed in the housing wall, each aperture corresponding to a specific capillary needle.

Figure 6:
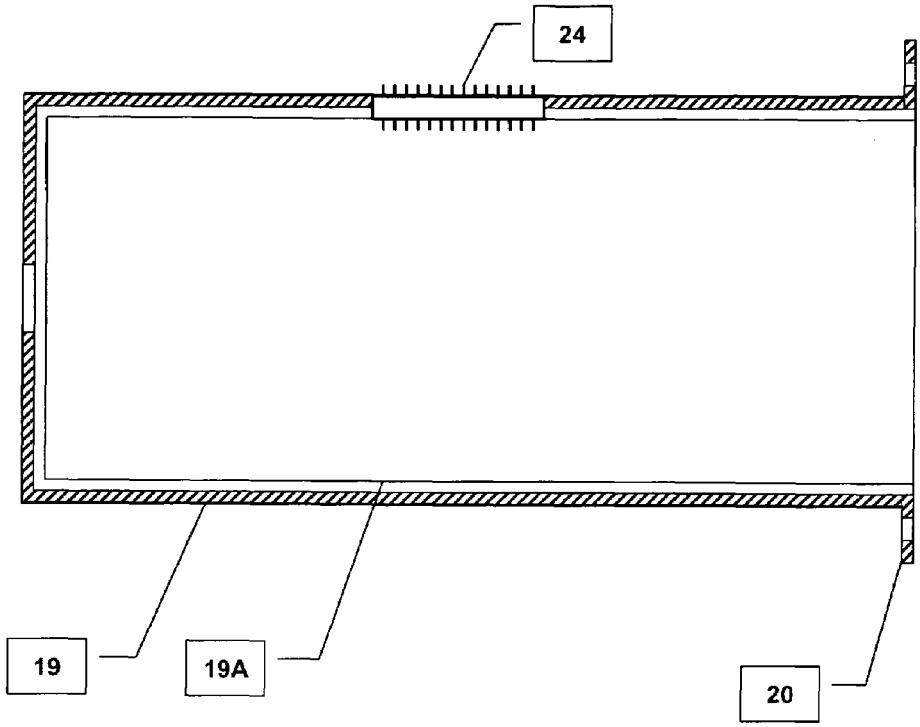
FIG. 6 shows an example of a vacuum chamber that may be used with the assembly of the present invention.

A vacuum chamber (19) is shown in FIG. 6. This chamber is designed to surround at least a portion of the housing (11) and serves to connect it to the vacuum system, pumps etc. The vacuum chamber may also be sealed by a membrane or septum through which the needle capillary (10) may pass. The septum material may be silicone rubber. The vacuum chamber material may be glass, stainless steel, aluminium or ceramic. The chamber connects the housing assembly (11), shown in FIG. 7, to the vacuum pump combination and is fully demountable for ease of maintenance. A mounting feature (19A) (e.g. a milled recess) may be machined inside the chamber (19) to accept and securely mount the substrate microbench assembly (1) and housing (11). The chamber is connected to the pump inlet via a standard flange (20) with suitable vacuum fittings, gaskets, o-rings, Viton seals and bolts etc. A suitable vacuum interconnector (24) couples with the edge connector (23) on the microbench substrate (1). In one embodiment this is a 'D-type' vacuum feed-through connector welded into the vacuum chamber side-wall.

Figure 7:
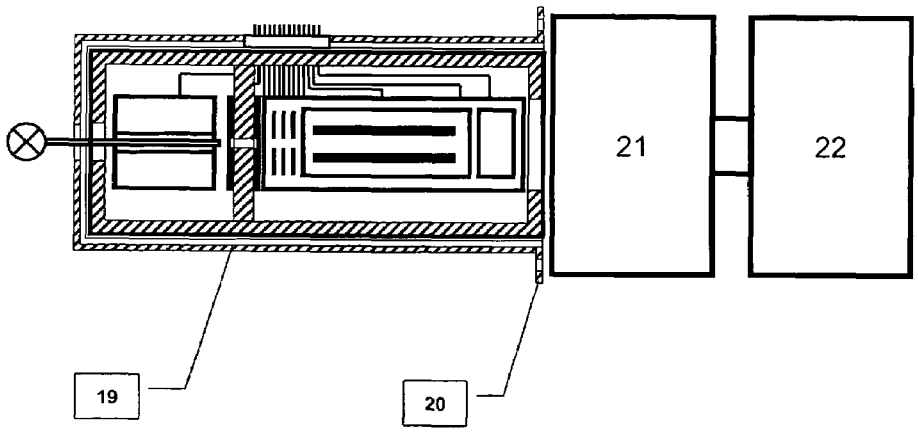
FIG. 7 shows the vacuum assembly of FIG. 6, enclosing an assembly, and coupled to a vacuum pump combination.

A typical system configuration is described in FIG. 7. The vacuum chamber (19), containing an integrated microbench/submount assembly, is connected via a standard flange (20) to a turbo pump (21) and backing pump (22) combination. An alternative configuration uses an ion pump (21) instead of a turbo pump, and a mechanical roughing pump (22) which may also be directly connected to region of higher pressure between (17) and (14). In this alternative embodiment, the flange (20) may also be sealed by a membrane between the chamber (19) and the ion pump (21) to smooth the pumping rate of different gases.

Figure 8:
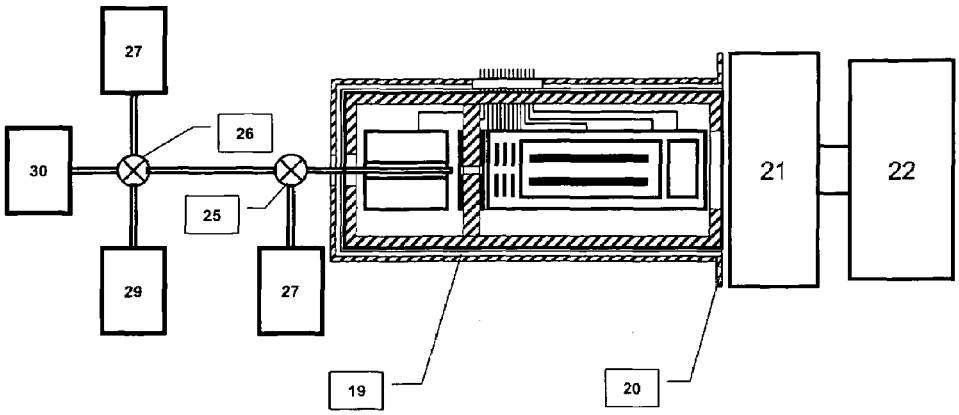
FIG. 8 shows a modification of the system of FIG. 7.

A further system based on the technology described here is outlined in FIG. 8. One application of this system is in the purification and fractionation of compounds by rapid selection of molecular masses. In this illustrated example of the system, the capillary needle is connected via a flow splitter (25) to another flow splitter valve (26) and to a UV detector (27). The UV detector provides additional information on the chemical composition and structure of the analyte which can be used for confirmation purposes. The active flow splitter (26) is connected to a make-up pump (27), a HPLC system (30) and a fraction collector (29). Once a molecular mass of interest is detected at the mass analyser, the active flow splitter (26) may be actuated to siphon off the sample of interest into the fraction collector (29). In this way combinational chemists can save valuable time and effort by rapidly selecting drug-bearing samples and discarding other samples. There is a further significant saving in cost of goods sold through the massive reduction in sample handling, storage, spillage and disposal this system permits.

It is known for electrospray ionisation sources to be coupled with two modes of liquid chromatography: microflow (with flow rates of for example 20 μL/min) and nanoflow (with flow rates of for example 20 nl/min). Ultra-high flow rate LC can be used for fast separation. They operate at a pressure of about 30,000 psi. Clearly these pressures and flows are not suitable for direct introduction to a mass spectrometer. Nanoflow LC offers sharper chromatography peaks (e.g. Full width half maximum resolution ~1 second) and therefore faster separation. An example of a nanoflow LC has an internal tube diameter of 50 um-70 um. The high back pressure problem has been eliminated through the use of low flow rates. Resolution is excellent, for example in a sample time of 1 min, peak widths of 1 second are achieved. A further advantage of nanoflow is that less solvent is used. This reduces aggregated solvent consumption, handling and waste disposal costs. For a typical nanoflow HPLC system 250 mL of solvent can last months. Therefore, there are significant cost of goods sold (COGS) savings associated with nanoflow LCMS throughout a large enterprise.

Splitters are normally used to reduce flow rate down to nanospray flow rates when the HPLC pumps are too fast. Nowadays, the move in nanospray is away from using splitters. Direct flow to the nanospray source is possible with pumps that pump at 200 nL/min down to 5 nL/min. This can be provided by electro-kinetic pumps which are available for HPLCs with pump rates down to a few nanoliters and can interface directly with the nanospray source. The low flow rates are possible because good control systems with closed-loop feedback have been developed. Another advantage of low flow rates is that response times are fast. In a transient blockage pressure rises and falls quickly. If nanoflow LC is used with a mass spectrometer, then a direct flow to the nanospray source is possible, eliminating the need for a flow splitter. The dimensions of a nanoflow LC need to be compatible with the desired resolution and flow rate. Tiny beads with a diameter of 1 um down to 0.5 um are used to densely pack the column so that compounds are quickly separated at a very low flow rate.

However in such systems, valves and capillary connectors are a limiting factor as they add dead volume. The more dead volume, the more peak tailing and deteriorating resolution is observed. A typical valve has a dead volume of more than 25 mL. Therefore minimising the number of valves and connections will improve LC resolution and separation efficiency.

Figure 9:
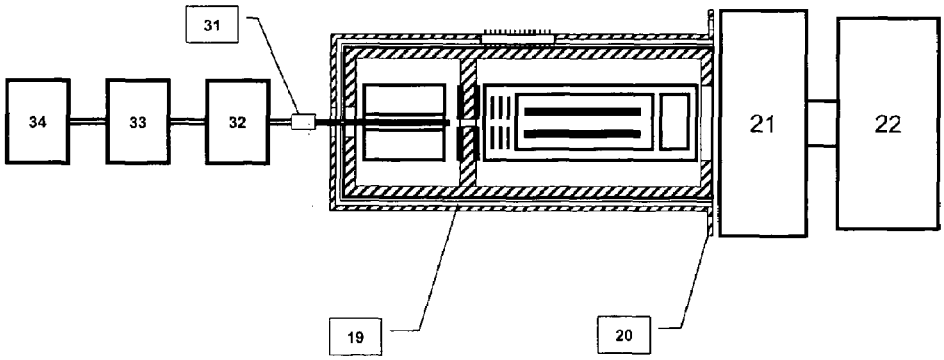
FIG. 9 shows a modification of the system of FIG. 7.

The integrated analyser of the present invention can be used to address these problems and a modification to that described here before is shown in FIG. 9. This arrangement avoids the use of a splitter and limits the number of connections and valves by permitting direct connection of the nanospray source to the HPLC system. Direct connection of the LC column to nanospray source at flow rates of 200 nL/min down to 5 nL/min is possible with commercially available electrokinetic pumps. A simple connector (31) directly connects the nanospray capillary to a nanoflow LC column (32). The LC column length and internal diameter are selected such that its flow rate is compatible with that required by the nanospray nozzle. Typical flow rates are 800 nL/min down to 1 nL/min. The LC column is in turn connected to a controllable pump (33), preferably of the type known as an electrokinetic pump, which in turn draws on reservoirs of solvent and sample (34).

Figure 10:
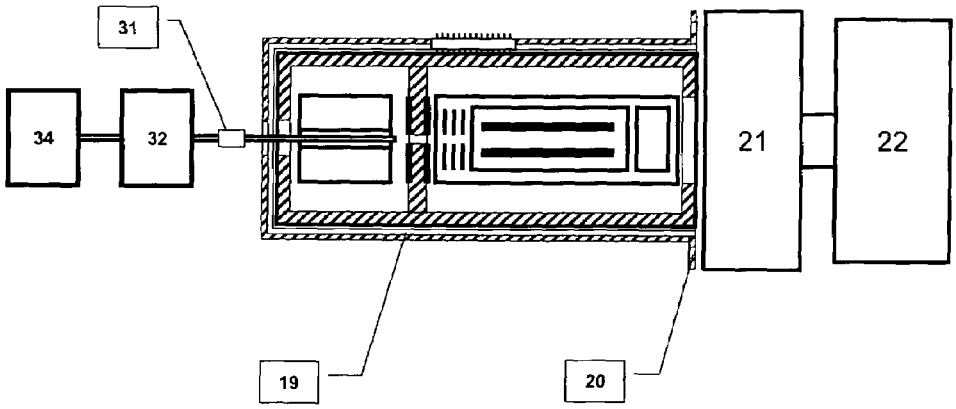
FIG. 10 shows a modification of the system of FIG. 7.

Yet another alternative system combination which avoids the use of a splitter and a controllable nanoflow pump is described in FIG. 10. This system would have significant cost advantages over those described above. A simple connector (31) directly connects the nanospray capillary to a nanoflow LC column (32). The LC column length and internal diameter are selected such that there is a hydrostatic pressure gradient between the reservoir (34) and the nanospray capillary needle (10), which may be mounted inside or outside the vacuum region as describer above. When carefully selected, the length and diameter of the LC column, and difference in hydrostatic pressure between the reservoir (34) at atmosphere and the nanospray capillary needle tip (10) at vacuum, creates a certain flow rate to the nanospray tip which promotes nebulisation and evaporation of droplets, and a flow through the LC column.

It will be appreciated that what has been described herein is an analytical instrument assembly comprising a microbench substrate on which is mounted a plurality of individual components. Each of these components may be provided on an individual submounts or more than one may be provided on a common submount. The alignment of the components relative to a desired position on the substrate is achieved by the use of one or more alignment features provided on the substrate. The location can be such as to co-locate the component with its respective alignment feature or alternatively the alignment feature is used as a fiduciary point or locator on the substrate and the component is located relative to that point. Where a plurality of submounts are provided, each of these is assembled relative to the others on the microbench which has been previously been provided with a plurality of alignment features—each of the alignment features being specifically positioned relative to its intended submount. Semiconductor 'microbench' technology is commonly used in the optoelectronics industry to cheaply align optical components where semiconductor laser sources are aligned on microbenches with optical fibres, detectors, and other components to maximise optical transmission and reduce assembly cost. This approach is applied in this patent to the problem of initiation of electrospray using a very well defined electric field, where factors such as applied voltage, needle diameter and needle position relative to the counter electrode and vacuum inlet are crucial. Furthermore, microbenches should permit the formation of an electrospray with very low cone voltages, increasing the number of multiply charged ions and boosting the mass range of cheaper mass analysers with a limited mass to charge range. Although the invention has been described with regard to specific embodiments and arrangements, it will be appreciated that numerous modifications can and may be made without departing from the scope of the invention which is not intended to be limited in any way except as may be deemed necessary in the light of the appended claims.

The words comprises/comprising when used in this specification are to specify the presence of stated features, integers, steps or components but does not preclude the presence or addition of one or more other features, integers, steps, components or groups thereof.

The invention claimed is:

1. An integrated analytical instrument assembly comprising a plurality of components including a mass spectrometer device and an electrospray ionisation source, individual components being initially provided on at least one submount of the assembly, the at least one submount being subsequently mountable on a microbench, the location of the at least one submount on the microbench being defined relative to at least one alignment feature provided on the microbench.

2. The assembly as claimed in claim 1 wherein a plurality of submounts are provided, individual components being provided on one or more of the submounts and further wherein the individual submounts are mountable on the microbench at locations defined by the at least one alignment feature, the at least one alignment feature determining the relative positioning of the mounted submounts relative to one another.

3. The assembly as claimed in claim 2 wherein a plurality of alignment features are provided on the microbench, each of the plurality of features being associated with a specific individual submount, the submount being located on the microbench coincident with the location of its respective alignment feature.

4. The assembly as claimed in claim 1 wherein the electrospray ionisation source includes an electrospray capillary needle and counter electrodes, the needle being provided on a capillary submount, the capillary submount including at least one microfabricated location feature configured to provide for an accurate alignment of the needle relative to the counter electrodes.

5. The assembly as claimed in claim 4 wherein the location feature is selected from one of:

a) an etched microchannel, and b) a v-groove provided along crystal planes of the submount.

6. The assembly of claim 5 wherein the capillary needle is coupled to its location feature using one or more of:

a) clips, b) microsprings, c) solder, d) electrically conductive epoxy or other glue.

7. The assembly as claimed in claim 1 wherein the mass spectrometer device includes an ion detector, ion optics and a mass analyser.

8. The assembly as claimed in claim 1 wherein the electrospray ionisation source is provided on a plurality of submounts, individual submounts being used for needle and electrode components of the source.

9. The assembly as claimed in claim 8, wherein a mass spectrometer submount is monolithically integrated with a counter-electrode submount such that the two components are provided on the same submount.

10. The assembly as claimed in claim 1 wherein the at least one alignment feature provided on the microbench is a microfabricated feature formed subsequent to a patterning of the microbench.

11. The assembly as claimed in claim 1 wherein the at least one alignment feature provided on the microbench is a micromachined feature.

12. The assembly as claimed in claim 1 wherein the microbench is provided with a plurality of conductive tracks, the tracks being configured to enable electrical connection to individual components on the submounts.

13. The assembly as claimed in claim 12 wherein the tracks provide for a transmission of power control or drive signals from external electronics or for transmission of signals to external electronics or for connection between individual components.

14. The assembly as claimed in claim 1 further including a housing, the housing being positioned relative to the microbench so as to encapsulate at least some of the components of the assembly.

15. The assembly as claimed in claim 14 wherein the housing is dimensioned so as to provide for regions of differing pressure within the housing.

16. The assembly as claimed in claim 14 wherein a mounting of the housing to the microbench is at a location defined by alignment features provided on the microbench.

17. The assembly as claimed in claim 14 wherein the housing is permanently bonded to the microbench.

18. The assembly as claimed in claim 14 wherein the housing defines two regions, a first region defining a first pressure area and a second region defining a second pressure region, the two areas being in communication with one another through an aperture.

19. The assembly as claimed in claim 14 wherein side walls of the housing are configured to receive counter electrode components of the electrospray.

20. The assembly as claimed in claim 14 further including a vacuum chamber, the vacuum chamber encapsulating at least a portion of the assembly and being coupled to a pump.

21. The assembly as claimed in claim 20 wherein the vacuum chamber and/or housing include a sealable inlet, the inlet being dimensioned to enable insertion of an electrospray needle into the vacuum chamber.

22. The assembly as claimed in claim 21 wherein the electrospray source is mounted to the microbench within the area defined by the vacuum chamber, the sealable inlet enabling a replacement of the needle.

23. The assembly as claimed in claim 21 wherein at least a portion of the electrospray source is located externally of the vacuum chamber, the inlet enabling a passing of the needle through walls of the vacuum chamber into the vacuum chamber.

24. The assembly as claimed in claim 21 wherein the inlet is sealable with a septum or membrane, the septum being dimensioned to seal around an inserted needle, thereby preventing a leak from an interior portion of the assembly to an exterior portion.

25. The assembly as claimed in claim 20 wherein the electrospray components are coupled to a flow splitter, the flow splitter being coupled to a fraction collector, the flow splitter being configured, in response to a detection of a sample of interest by the mass spectrometer, to siphoning off a portion of the sample of interest to the fraction collector.

26. The assembly as claimed in claim 20 wherein the pump is an ion pump.

27. The assembly as claimed in claim 1 wherein an array of mass spectrometer devices and associated electrospray ionisation sources are provided, the array being configured to provide for a plurality of analyses to be conducted in parallel.

28. The assembly as claimed in claim 1 wherein the mass spectrometer is formed as a MEMS device.

29. The assembly as claimed in claim 1 wherein the microbench is formed from a silicon substrate.

30. A liquid chromatography mass spectrometer system including reservoir of solvent and sample to be analysed in fluid communication with a nanoflow chromatography column, and an assembly as claimed in claim 1, the electrospray ionisation source of the assembly being a nanospray ionisation source and being configured to provide a mount for a nanospray capillary needle which may be coupled to the nanoflow chromatography column.

31. The mass spectrometer system as claimed in claim 30 wherein the flow of solvent and sample through the chromatography column to the nanospray ionisation source is maintained by a hydrostatic pressure difference between the reservoir and the nanospray capillary needle.

32. The mass spectrometer system as claimed in claim 31 wherein the reservoir is maintained at atmospheric pressure and the nanospray capillary needle is maintained within a vacuum.

33. The mass spectrometer system as claimed in claim 30 further including an electrokinetic pump, the pump being configured to provide a flow of sample from the reservoir to the nanospray capillary needle.

34. A method of providing a self aligned mass-analysing assembly, the assembly including at least an electrospray ionisation source and a mass spectrometer, the method including the steps of:

providing a substrate, providing at least one alignment features on the substrate, providing at least one submount, the at least one submount having mounted thereon selected ones of the electrospray ionisation source and the mass spectrometer, and mounting the assembled submount on the substrate, the relative position of the submounts on the substrate being determined with respect to the at least one alignment feature.

* * * * *